US005845345A

United States Patent [19]

Ko

[11] Patent Number: 5,845,345

[45] Date of Patent: Dec. 8, 1998

[54] WALL-MOUNTED TAP HAVING REMOVEABLE SHOWER HEAD SPOUT

[75] Inventor: Hsi-Chia Ko, Changhua Hsien, Taiwan

[73] Assignee: Chung Cheng Faucet Co., Ltd., Changhua Hsien, Taiwan

[21] Appl. No.: 932,241

[22] Filed: Sep. 17, 1997

[51] Int. Cl.[6] ..... E03C 1/04

[52] U.S. Cl. ..... 4/678

[58] Field of Search ..... 4/675–678; 137/801

[56] References Cited

U.S. PATENT DOCUMENTS

| | | | |
|---|---|---|---|
| 5,079,781 | 1/1992 | Gnauert et al. | 4/676 |
| 5,090,062 | 2/1992 | Hochstrasser | 4/678 |
| 5,349,987 | 9/1994 | Shieh | 137/801 |
| 5,575,424 | 11/1996 | Fleischmann | 4/677 X |

*Primary Examiner*—Charles E. Phillips

*Attorney, Agent, or Firm*—Browdy and Neimark

[57] ABSTRACT

A wall-mounted tap has a single removable shower head spout., and more particularly the tap is equipped with a check valve and a vacuum breaker so as to avoid filthy water from being reversely sucked into the running water supply system by way of the shower head plunged in a sink in a fire extinguishing process. The tap includes a tap mount, a tap body, a valve mount, a vacuum breaker, a check valve, a pair of hot and cold water inlet pipes and a water outlet pipe and a removable hand held shower head. The vacuum breaker is made up of a nut, a valve stem and a spring. The spring is securely mounted onto the valve stem that is housed both in a hole on a vertical tubular tap seat and a receiving hole in communication with the water outlet pipe on the valve mount and is locked in place by the nut. The check valve coupled to one end of the water outlet pipe is mounted onto the valve mount to which the hot and cold water inlet pipes and the water outlet pipe are connected so as to produce a double check effect.

2 Claims, 4 Drawing Sheets

WALL-MOUNTED TAP HAVING REMOVEABLE SHOWER HEAD SPOUT

BACKGROUND OF THE INVENTION

The present invention relates to a wall-mounted tap having a single removable shower head spout, and more particularly to a tap equipped with a check valve and a vacuum breaker so as to avoid filthy water from being reversely sucked into the running water supply system by way of the shower head plunged in a sink in a fire extinguishing process. The tap includes a tap mount, a tap body, a valve mount, a vacuum breaker, a check valve, a pair of hot and cold water inlet pipes and a water outlet pipe and a removable hand held shower head. The vacuum breaker is made up of a nut, a valve stem and a spring. The spring is securely mounted onto the valve stem that is housed both in a hole on a vertical tubular tap seat and a receiving hole in communication with the water outlet pipe on the valve mount and is locked in place by the nut. The check valve coupled to one end of the water outlet pipe is mounted onto the valve mount to which the hot and cold water inlet pipes and the water outlet pipe are connected so as to produce a double check effect.

In many household kitchens in modem countries, taps equipped with a single removable or detachable shower head spout are popularly employed, making the cleaning of dishes and cooking utensils in a more convenient manner. However, such taps are generally not equipped with check valves for prevention of reverse flow of filthy water. Such water can be produced in a fire extinguishing process and sucked into the water supply duct when the shower heads are dropped randomly in sinks during fire accidents. As shown in FIG. 1, when water is massively pumped by the fire department in a flaming area, a negative pressure will be produced in the nearby running water supply system, resulting in the suction of filthy water not only into the household water systems but over time also into a public running water supply system.

SUMMARY OF THE INVENTION

Therefore, the primary object of the present invention is to provide a wall-mounted tap having a single removable shower head spout which is equipped with a check valve and a vacuum breaker so as to avoid filthy water from being reversely sucked into the running water supply duct when the shower head is randomly plunged into a sink during a fire extinguishing process.

Another object of the present invention is to provide a wall-mounted tap having a single removable shower head spout which is provided with a vacuum breaker to prevent the tap from leakage when a running water supply system resumes its water supply after the fire department stops pumping water from the water supply system.

DETAILED DESCRIPTION OF THE PREFERRED EMBODIMENT

Figure 1:
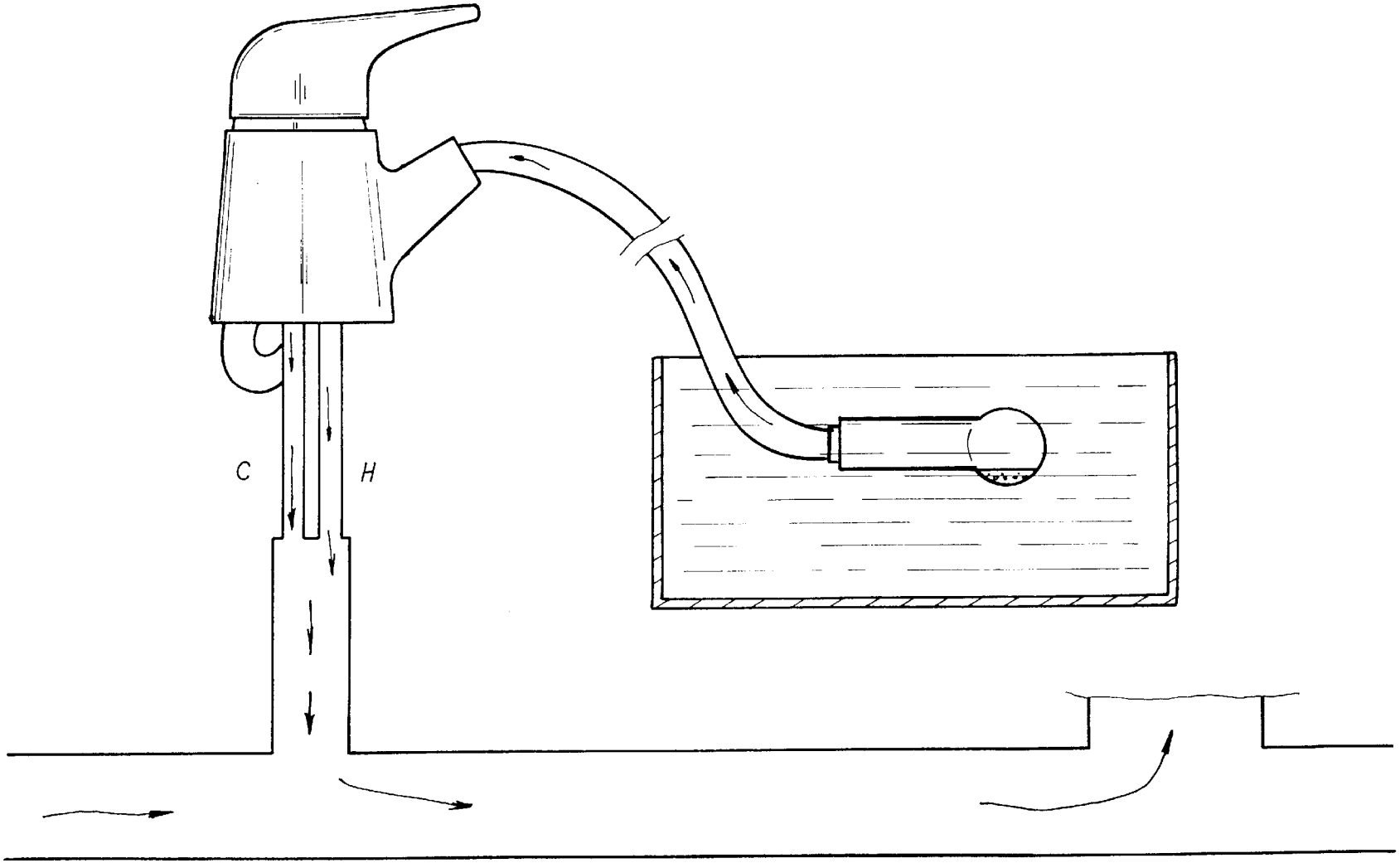
FIG. 1 PRIOR ART
FIG. 1 is a diagram showing the shower head of a conventional faucet being plunged in a sink fall of filthy water which will be drawn into the water supply line by the shower head.
Figures 2, 2A:
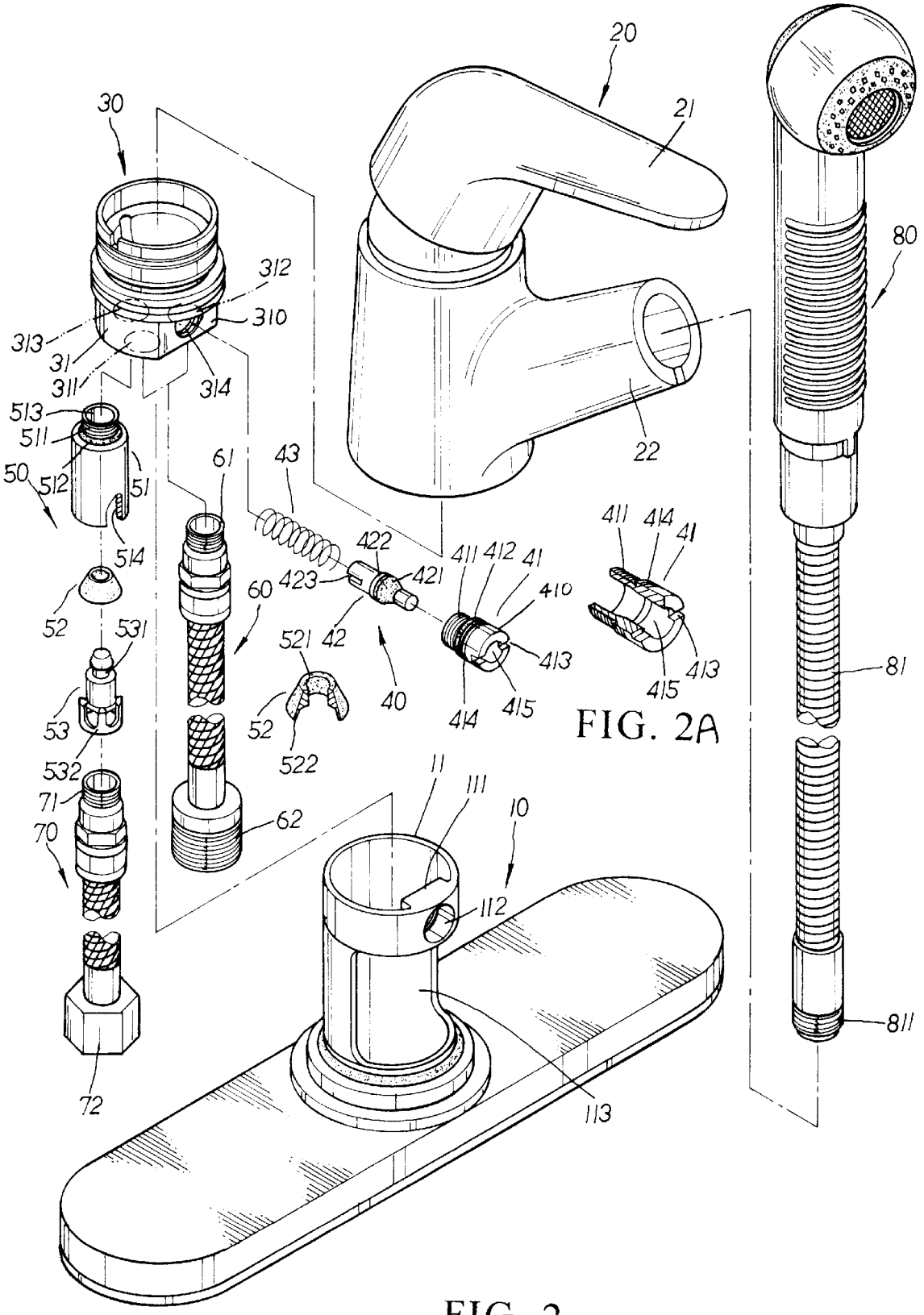
FIG. 2 is a perspective diagram showing the exploded components of the present invention.
FIG. 2A is an enlarged diagram showing the details of a nut of the vacuum breaker.

Referring to FIG. 2, the present invention is comprised of a tap mount 10, a tap body 20, a valve mount 30, a vacuum breaker 40, a check valve 50, a pair of hot and cold water inlet pipes 60, one water outlet pipe 70, a removable shower head 80.

At the middle of the tap mount 10 projects a tubular tap seat 11 having an internal retaining block 111. In alignment with the retaining block 111 an innerly threaded hole 112 is drilled from the outer surface of the tap seat 11. On the tubular tap seat 11 and under the retaining block 111 is disposed an axial opening 113.

A control handle 21 is mounted onto the tap body 20 which is equipped with slantly extended holding tube 22. At the bottom of the valve mount 30 is disposed a positioning block 31 on which are located two water inlets 311, 312 and one water outlet 313. A flat cut face 310 is defined on the positioning block 31 and an innerly threaded receiving hole 314 in communication with the water outlet 313 is placed at the middle of the flat cut face 310.

The vacuum breaker 40 is equipped with a nut 41, a valve stem 42 and a spring 43. The nut 41 is made in a two-stage form, an outerly threaded small section 411 in connection to a large section 410 with a seal ring 412 defined therebetween. At the end of the nut 41 is provided with two symmetric splits 413. At the root of the large section 410 is disposed outer threads 414. Inside the nut 41 is defined a countersink hole 415 with a properly tapered section defined at the intersection of the differently sized holes of the countersink hole 415.

The valve stem 42 is also made in a two-stage form, having a conically tapered section 421 and a limiting flange 422 defined at the intersection of the two different diametered rods of the valve stem 42. At the end of the large rod section is defined an axially extended cut 423.

The check valve 50 is made up of a connection cap 51, a flat end cone-shaped check pad 52 and a valve member 53. The cap 51 is provided with a short outerly threaded tube 511 at the top end thereof and a seal ring 512 is disposed at the bottom of the tube 511. The short tube 511 has an inner hole 513 defined in a twostage form and having a tapered section at the intersection of the differently diametered holes. The larger hole of the tube 51 has inner threads 514.

The flat end cone-shaped check pad 52 has a peripheral seal skirt 522 extended from the bottom of the conic face 521. The valve member 53 has an engagement neck 531 and at the bottom thereof are disposed a number of spaced openings 532.

The hot and cold water inlet pipes 60 are provided with an outerly threaded connection ends 61, 62 at the top and the bottom thereof respectively. The top of the water outlet pipe 70 is provided with a connection end 71, and an adjustable nut 72 is secured to the bottom end thereof. The rear end of the shower head 80 is connected to an extensible duct 81 which is equipped with a coupling head 811 at the bottom end thereof.

Figure 3:
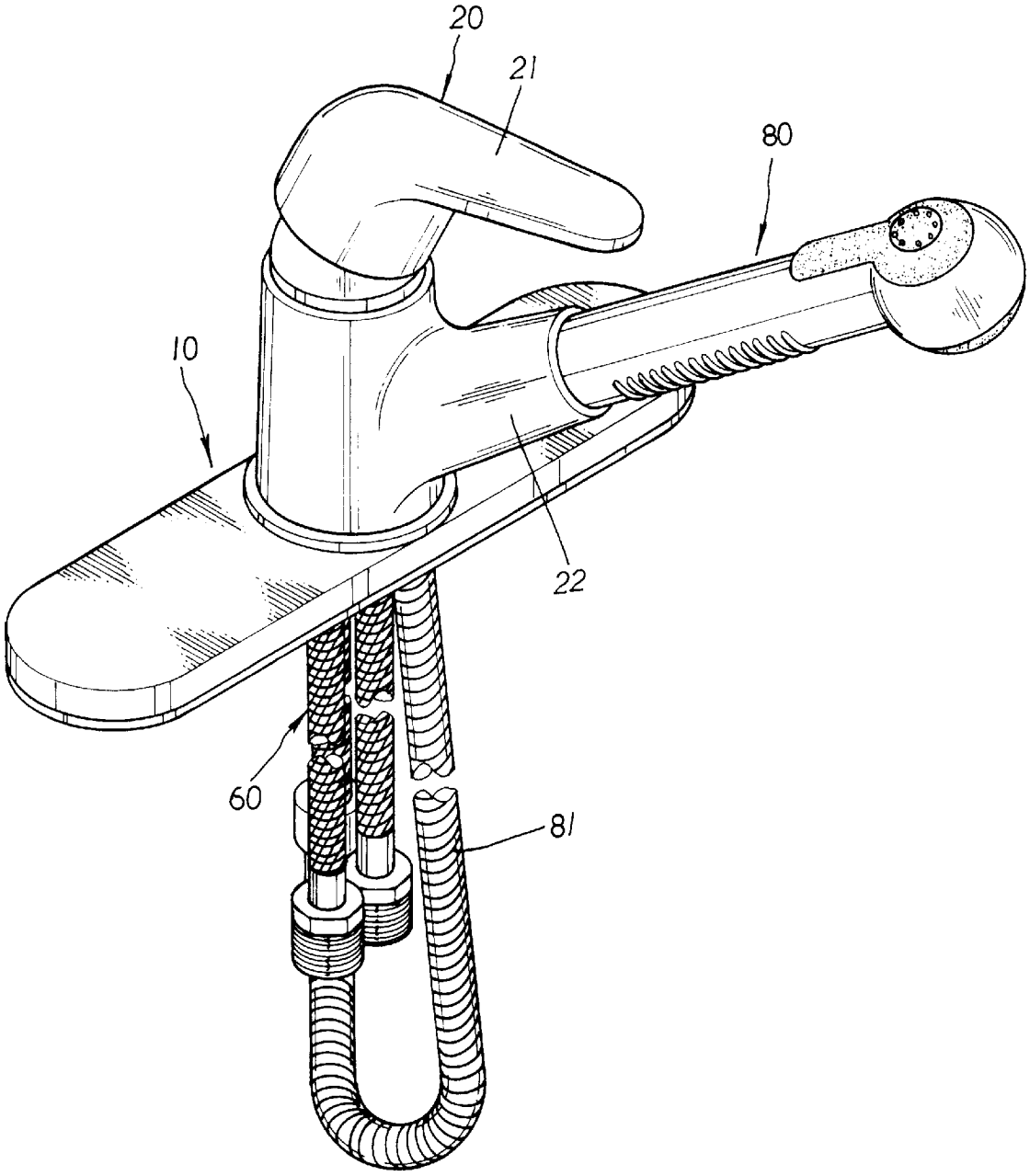
FIG. 3 is a perspective diagram showing the assembly of the present invention.

Referring to FIG. 3, the assembly of the present invention is illustrated. At first, the outerly threaded connection ends 61 of the hot and cold water inlet pipes 60 are engaged with the water inlets 311, 312 of the valve mount 30 respectively. Then the outerly threaded short tube 511 of the connection cap 51 is engaged with the innerly threaded water outlet 313. Then, the flat end cone-shaped check pad 52 is mounted onto the neck 531 of valve member 53. The valve 50 is placed in the larger portion of the hole 513 of the connection cap 51 and the outerly threaded connection end 71 of the outlet pipe 70 is engaged with the bottom end of connection cap 51 which has inner threads 514 at the larger portion of the connection cap 51. Next, the valve mount 30 is placed in the tubular tap seat 11 in such a manner that the flat cut face of the positioning block 31 is in retaining engagement with the internal retaining block 111 of the tap seat 11. The hot and cold water inlet pipes 60 and the water outlet pipe 70 are led through the tap mount 10 and are exposed externally.

The spring 43 of the vacuum breaker 40 is mounted onto the larger rod section of the valve stem 42 and is in limiting abutment against the limiting flange 422. Then, the valve stem 42 and the spring 43 are put into the innerly threaded hole 112 of the tubular tap seat 11 of the tap mount 10 and is further inserted into the receiving hole 314 of the valve mount 30. Then, the nut 41 of the vacuum breaker 41 is securely engaged with the receiving hole 314 of the valve mount 30 by way of the outer threads 411 of the nut 41 and the inner threads of the receiving bole 314. In the meanwhile, the outer threads 414 of the large section 410 are engaged with the inner threads of the hole 112 of the tubular tap seat 11. Afterwards, the tap body 20 is engaged with the tubular tap seat 11 of the tap mount 10 with the holding tube 22 of the tap body 20 in alignment with the axial opening 113 first and then the shower head 80 is inserted into the holding tube 22. The extensible duct 81 of the shower head 80 is led through the axial opening 113 of the tubular tap seat 11 and is connected to the water outlet pipe 70 by engaging the rear coupling head 811 of the duct with the adjustable nut 72 to complete the assembly.

Figure 4:
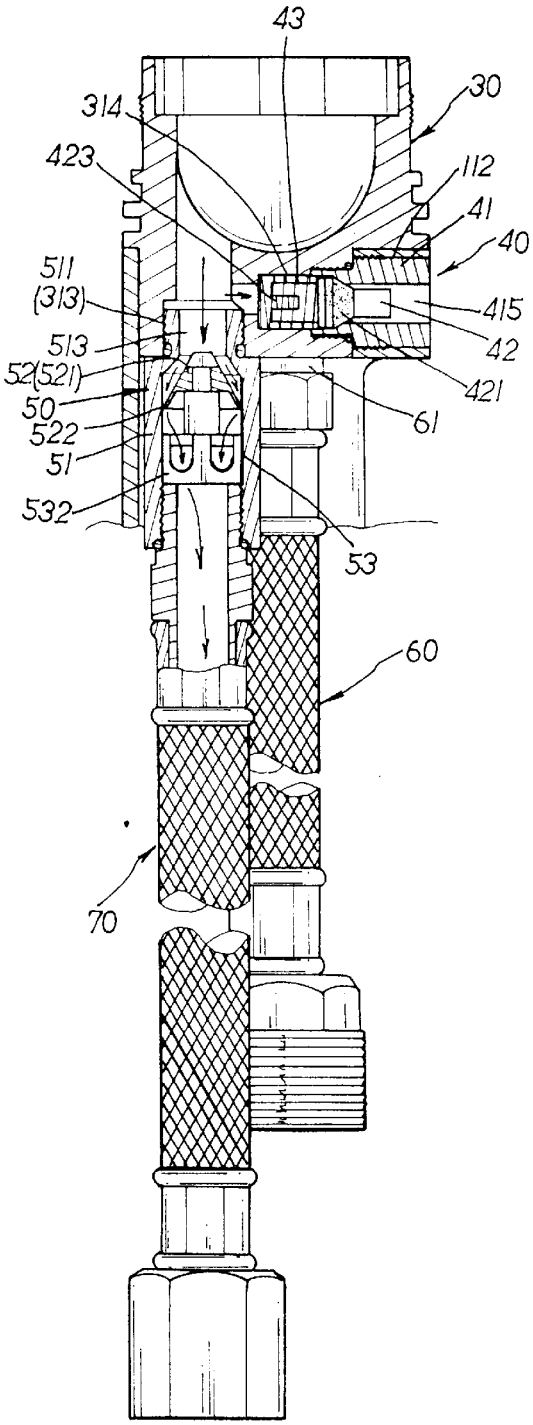
FIG. 4 is a sectional diagram showing a normal state of discharge of water of the shower head of the present invention.

Referring to FIG. 4, the normal state of water discharge of the present invention is shown. In the discharge, water flushes downwardly against the flat end cone-shaped check pad 52 of the check valve 50, making the conic face 521 of the cone-shaped check pad 52 disengaged from the tapered area of the connection cap 51 with the peripheral skirt 522 inwardly moved so as to permit water to flow into the water outlet pipe 70 via the spaced opening 532 of the valve member 53 and further be discharged via the shower head 80. At the same time, the valve stem 42 of the vacuum breaker 40 is urged outwardly by the spring force and water pressure, making the conically tapered section 421 of the valve stem come into close engagement with the tapered countersink hole 415 of the nut 41 so as to prevent water from flowing via the hole 415.

Figure 5:
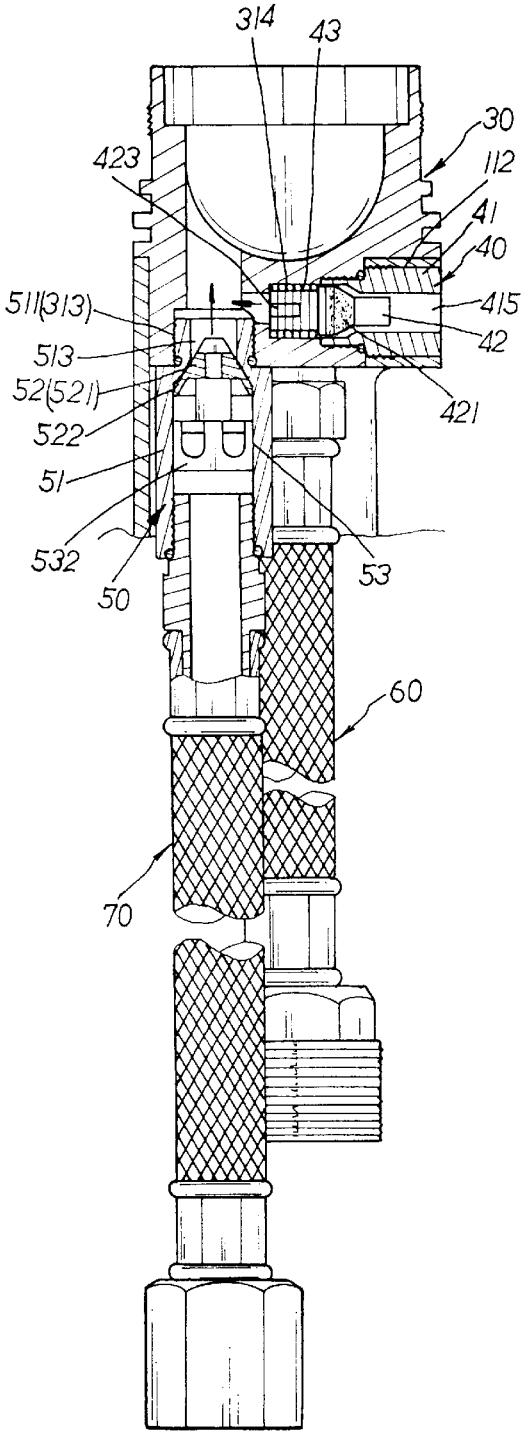
FIG. 5 is a sectional diagram showing the reverse flow of water being stopped and the vacuum state broken in the present invention.

Referring to FIG. 5, the way of how the vacuum breaker 40 is operated is shown. When the shower head 80 is dropped in a sink by a person running away from a fire accident, the massive pumping of water from a nearby running water supply system will cause, via the shower head 80 a negative pressure which makes the flat end cone-shaped check pad 52 along with the valve member 53 move upwardly. The check pad 52 is pushed by in-flushed filthy water and sucked by the negative air pressure at the same time to make the conic face 521 of the check pad 52 abut against the tapered hole 513 of the connection cap 51 and the outwardly expanded peripheral skirt 522 of the check pad 52 abut against the bottom area of the tapered hole 513 of the connection cap 51 to effect check on a reverse flow.

In the meanwhile, the vacuum stem 42 of the vacuum breaker 40 is sucked to move against the spring 43 so as to make the conically tapered section 421 of the valve stem 42 disengage from the tapered hole 415 of the nut 41, permitting external air to flush in the valve mount 30 via the tapered hole 415 of the nut 41 and the axially extended cut 423 of the valve stem 42 to break the vacuum state in the tap. Thus, it can protect the tap from being crushed by the external air due to the vacuum state in the tap. In the meanwhile, the valve stem 42 can be pushed back by the spring 43 after a fire is extinguished with the running water supply system resumes its normal state to guard the tap from leakage in use.

It can be clearly seen that the check valve of the present invention can effectively prevent filthy water from reversely flushing into a running water supply system by way of the shower head 80 randomly dropped in a sink in the first place. In the second place, the valve stem 42 of the vacuum breaker 40 is outwardly urged by the spring 43 to get the hole 415 closed so as to prevent water leakage when water supply system resumes its normal operation.

I claim:

1. A wall-mounted tap with a single shower head spout, comprising:

a tap mount; a tap body; a valve mount; a vacuum breaker; a check valve; a pair of hot and cold water inlet pipes; one water outlet pipe; a removable shower head; a tubular tap seat having an internal retaining block; said tubular tap seat projecting from a middle of said tap mount; said retaining block having an inner threaded hole drilled from an outer surface of said tap seat; said tubular tap seat further having an axial opening under said retaining block;

a control handle mounted onto said tap body; said tap body further having a slanted holding tube; said valve mount having a positioning block thereon; said positioning block having two inner threaded water inlets and an inner threaded water outlet;

a flat cut face being defined on the positioning block and an inner threaded receiving hole in communication with said water outlet at a middle of said flat cut face;

said vacuum breaker being equipped with a nut, a valve stem and a spring; said nut having an outer threaded first section engaged to a second section with a seal ring defined therebetween; said first section having a smaller diameter than said second section; said nut having two symmetric splits at an end thereof; said second section having outer threads at an end nearest to said first section; a countersink hole comprising two differently sized holes with a tapered section defined at an intersection of the two differently sized holes; said valve stem having a conically tapered section and a limiting flange defined at the intersection of the first section and the second section of the valve stem; said second section having an axially extended cut at a free end thereof;

each end of said hot and cold water inlet pipes are respectively provided with an outer threaded connection; a top of said water outlet pipe is engaged to a bottom of a connection cap which houses said check valve; and an adjustable nut is secured to a bottom end of said water outlet pipe; a rear end of said shower head is connected to an extensible duct having a coupling head at the bottom end thereof;

in assembly, one said outer threaded connection end of each of said hot and cold water inlet pipes is respectively engaged with said two inner threaded water inlets of said valve mount, and a threaded top of the connection cap is engaged with the inner threaded water outlet of said valve mount;

thereafter, said valve mount is placed in a tubular tap seat so that the flat cut face of the positioning block is in engagement with said internal retaining block of said tap seat; said hot and cold water inlet pipes and said water outlet pipe being led through said tap mount and being exposed externally; said spring of said vacuum breaker being mounted onto the second section of said valve stem and being in limiting abutment against said limiting flange; said valve stem and said spring being housed in the inner threaded hole of said tubular tap seat of said tap mount and being further inserted into the receiving hole on said flat cut face; said outer threaded first section of said nut of said vacuum breaker being securely engaged with said inner threaded receiving hole on said flat cut surface, the outer threads of the second section being engaged with the inner threaded holes on said tubular tap seat; said tap body being engaged with said tubular tap seat with said slanted holding tube placed in alignment with said axial opening, said shower head being inserted into said slanted holding tube; said extensible duct of said shower head being led through said axial opening connected to said water outlet pipe by engaging the rear coupling head of said duct with said adjustable nut of said water outlet pipe.

2. The wall-mounted tap as claimed in claim 1, wherein said check valve comprises:

the connection cap, a flat-end cone-shaped check pad and a check valve member; said connected cap is provided with a short outer threaded tube at the top end thereof and a seal ring disposed at a bottom of said outer-threaded tube;

said short tube having an inner hole including a tapered section at the intersection of the differently-sized holes; a larger hole of the tube having inner threads;

said flat-end cone-shaped check pad having a peripheral seal skirt extending from a bottom thereof; said check valve member having an engagement neck and at the bottom thereof a number of spaced openings; wherein said connection cap is removably engaged with said inner threaded water outlet of said valve mount by the outer threaded top end thereof; said flat-end cone-shaped check pad being mounted in said engagement neck of said valve member; said valve member along with said check pad being housed in said connection cap which is then removably secured to the top end of said water outlet pipe so as to effect a check on said tap to prevent a reverse flow from flushing into said tap through said shower head.

* * * * *